United States Patent [19]

Reven et al.

[11] 4,093,778

[45] June 6, 1978

[54] INGOT MOLD FOR PRODUCING STEEL INGOTS

[75] Inventors: Frederick V. Reven, Homewood; Charles W. Connors, Wilmette, both of Ill.

[73] Assignee: Nalco Chemical Company, Oak Brook, Ill.

[21] Appl. No.: 722,176

[22] Filed: Sep. 10, 1976

[51] Int. Cl.[2] ..... B22C 3/00

[52] U.S. Cl. ..... 428/411; 106/38.23; 106/38.27; 106/38.28; 164/72; 164/138; 249/114; 428/469

[58] Field of Search ..... 164/41, 138, 72, 73; 249/114; 427/133, 135; 106/38.23, 38.27, 38.28, 38.3; 428/469, 411

[56] References Cited

U.S. PATENT DOCUMENTS

| | | | |
|---|---|---|---|
| 3,146,113 | 8/1964 | Middleton et al. | 106/38.23 |
| 3,275,460 | 9/1966 | Jeanneret | 106/38.23 X |
| 3,330,674 | 7/1967 | Santmyer | 106/38.5 R |
| 3,340,082 | 9/1967 | Meyer et al. | 106/38.23 X |
| 3,910,798 | 10/1975 | Shires et al. | 106/38.3 |

FOREIGN PATENT DOCUMENTS

| | | | |
|---|---|---|---|
| 848,843 | 8/1970 | Canada | 164/72 |
| 270,965 | 8/1970 | U.S.S.R. | 164/41 |
| 380,390 | 7/1973 | U.S.S.R. | 164/72 |
| 316,522 | 12/1971 | U.S.S.R. | 106/38.9 |

*Primary Examiner*—Francis S. Husar
*Assistant Examiner*—Gus T. Hampilos
*Attorney, Agent, or Firm*—John G. Premo; Robert A. Miller; Barry W. Sufrin

[57] ABSTRACT

An improved ingot mold for producing steel ingots is disclosed. The primary feature of this improved mold is an interior sidewall coating which is composed of an aqueous slurry of finely divided iron oxide and a lignosulfonate.

10 Claims, 1 Drawing Figure

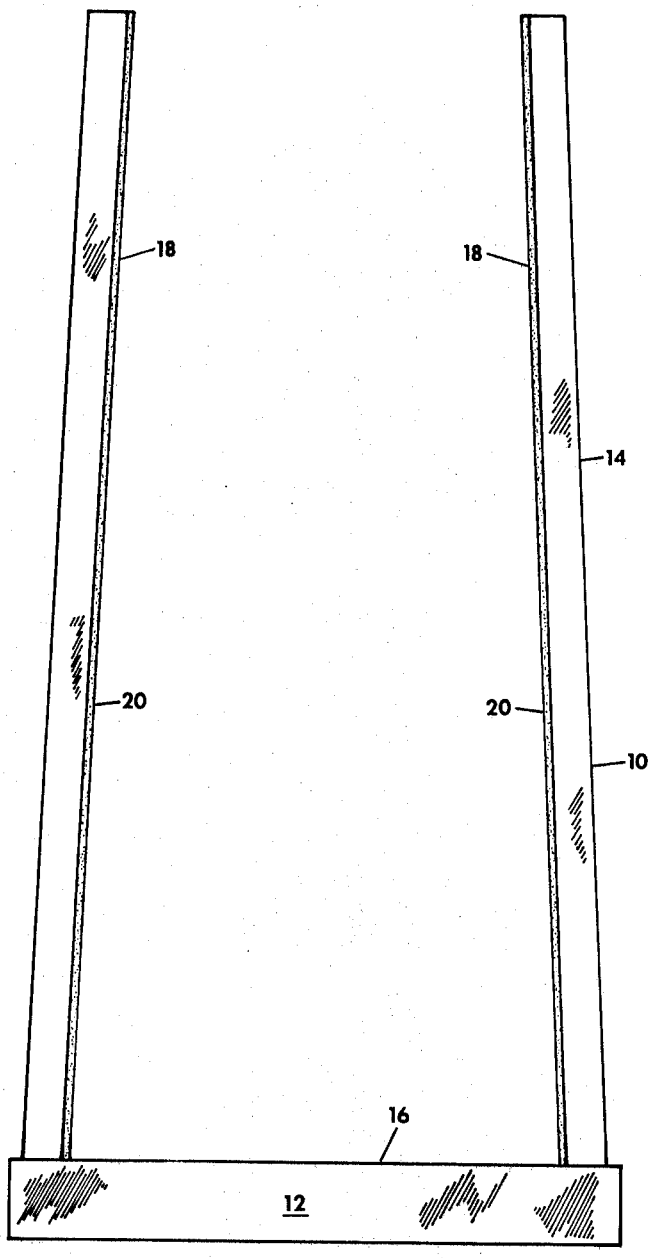
18
18
14
20
20
10
16
12

INGOT MOLD FOR PRODUCING STEEL INGOTS

INTRODUCTION

It has been the practice in the processing of molten metals to apply a coating to the surface of molds prior to pouring metal into the molds. This practice has been followed extensively in the steel industry, where ingot molds are normally coated prior to the forming of steel ingots. The recognized purpose of all of these coatings has been to improve the surface qualities of the molded steel. The function that most mold coatings are designed to perform is one of repelling splashes of molten metal and preventing them from solidifying on the mold walls. Other important functions of mold coatings used in the processing of molten steel are to reduce mold wear and to afford a good parting plane.

The surface of solidified metal, which results from splashes adhering to the mold walls, normally oxidizes very rapidly. This surface oxidation plus high heat capacity acquired by adhering to the mold prevents the metal, which results from the splashes, from being incorporated into the main body of the ingot after the mold has been completely filled.

The failure of the metal from the splash to be incorporated into the main body of a metal ingot results in surface discontinuities, which must be removed from the ingot by burning, scarfing, grinding or other suitable means prior to fabrication of the ingot into shapes or sheets. If the discontinuities are not removed by one of these types of operations, they will result in defects in the finished metal products.

Various organic and inorganic materials have been tested in prior art endeavors to solve the problem of surface defects in metal, which are caused by splashes adhering to mold walls. Coal tar graphite, asphalt and various combinations of these and similar materials have been most widely used. These materials have all been unsatisfactory in that the improvement in metal surface resulting from their use has been relatively slight in comparison to the expense and difficulty involved in applying them to molds.

The flammability of some of the prior art materials is undesirable from a safety point of view and all of the materials results in smoke and/or noxious fumes of one form or another. The materials containing a higher percentage of graphite are the least flammable and result in the lowest amount of smoke; however, they are extremely dirty and difficult to handle and apply to the mold walls.

Various inorganic materials have been tested for use as mold coatings with varying degress of success, as to improvement of the surface qualities of the metal. None of these materials have been truly satisfactory or acceptable to the steel industry, due to non-metallic inclusions, which they have a tendency to introduce into the metal.

One of the materials that has been tested in the past as a mold coating is magnetite ($Fe_3O_4$) which, when actually applied to ingot molds and steel cast therein, produces finished ingots having sub-surface holes. These sub-surface holes result in finished steel products which are unacceptable and must be recycled. A demonstration of the inability of iron oxide to act as a mold coating is set form in "Effect of Mold Wall Preparation on Seams in Semikilled Steel Slabs," by J. C. Seastone, from Volume 47 of the *Proceedings of the Forty-Seventh National Open Hearth and Basic Oxygen Steel Conference of the Iron and Steel Division,* held in Buffalo, New York, Apr. 13–15, 1964.

THE DRAWING

For a more complete understanding of this invention, reference may be had to the drawing which is a vertical cutaway view of a typical ingot mold used to produce steel ingots.

With specific reference to the drawings, the ingot mold is designated generally by the numeral 10. The mold is comprised of a base or stool 12 upon which rests a cylindrically-shaped mold designated generally by the numeral 14. As shown in the drawing, the bottom 16 of the mold 14 has its inner walls 18 coated with a coating 20 of the invention. While the drawing illustrates a "big end down" mold, it will be understood that the invention is also useful in treating "big end up" molds into which molten ferrous metals are poured.

THE MOLD COATING COMPOSITIONS

The compositions used in preparing the coating 20 in their most generic aspects contain from 5–30% by weight of a finely divided iron oxide, specifically $Fe_2O_3$, hematite. In a preferred aspect of the invention, the finely divided iron oxide is present in an amount ranging between 10–25%.

The second ingredient used in the coatings of this invention is a lignosulfonate which is used in an amount ranging between 0.1–25% by weight and, in a preferred embodiment, is present in an amount ranging between 2–10% by weight.

The balance of the composition which contains both the iron oxide and the lignosulfonates is water.

In addition to containing iron oxide and lignosulfonates, the compositions may optionally contain additional ingredients, one of which is finely divided graphite which may be present in an amount ranging between 5–20% with a preferred range being 5–15%.

Yet another optional yet beneficial ingredient is formic acid or salts thereof, most specifically, alkali metal salts thereof. This component of our formula should be used in amounts ranging between 0.1–10% by weight with a preferred quantity being in the range of 3–8% by weight.

Another useful but yet not entirely essential ingredient is a water-soluble or dispersible thickening agent which may be either a water-soluble polymeric material or a clay. This component is present in amounts ranging between 0.1 to about 5% by weight with preferred quantities being in amounts ranging from 0.1 to 2% by weight.

Still another optional ingredient that may be used to prepare the compositions used in this invention is a biocide which may be incorporated into the formula in an amount ranging between as little as ½ ppm up to amounts as great as 2,000 ppm.

Finally, in certain instances where formula stability is important, minor amounts, e.g. 0.01 up to about 1% by weight of sodium hexametaphosphate may be employed.

THE FINELY DIVIDED IRON OXIDE

The finely divided iron oxide should be relatively pure and be predominantly composed of $Fe_2O_3$. From a physical standpoint, the iron oxide should not have a particle size greater than 100 mesh (Tyler). An excellent source of such an iron oxide are the fine iron oxides which are collected from basic oxygen furnace precipitrons.

THE LIGNOSULPHONATES

The lignosulfonates which are useful in the subject invention are the ammonium, alkali metal and alkali earth metal salts of lignosulfonic acid and lignosulfonic acids themselves. Methods of manufacture of lignosulfonic acid and various lignosulfonate salts are well known to the art. Suitable methods for the production of lignosulfonic acid and the isolation of various lignosulfonate salts are given by Friedrich Emil Brauns in the Chemistry of Lignin, published in 1952 by the Academic Press, Inc., of New York. A particular method for isolating lignosulfonic acid and manufacturing the various lignosulfonate salts is discussed on pages 111–125.

It is understood, however, that the practice of the subject invention is not limited to the use of lignosulfonates which are manufactured by any particular process.

All of the various ammonium, alkali metal and alkali earth metal salts and the free acids are useful in the practice of the invention. The preferred lignosulfonates are the ammonium, sodium, and calcium lignosulfonates and combinations thereof.

The lignosulfonates add anti-spillation protection to the ingot. Upon contact with the molten steel or in its vicinity, they immediately vaporize from the coating, thereby tending to prevent surface defects in the finished ingots.

GRAPHITE

Again, this material, as in the case of the iron oxide, must be in a state of fine subdivision. A typical graphite powder should have a Tyler mesh size of about 325 mesh. Also, it is important that when graphite is used in the formulas that it is not present in excess of 20% by weight of the total formula.

FORMIC ACID

Formic acid, when used in the compositions herein described, is preferably in the form of its alkali metal salt such as sodium formate. The acid may be used as such or other metal ammonium or amine salts may be used. The formic acid as previously indicated, is used in small amounts. Its purpose is to reinforce with an action of the lignosulfonates when they are used. It has an exceptionally high carbonization temperature, therefore making it much slower burning than the lignosulfonates.

THICKENING AGENT

When formulas of the above type are prepared by slurrying them into water, they form relatively unstable suspensions which means that they must be agitated during the period of application in order to produce uniform coatings. To aid in keeping the materials dispersed and to do away with the necessity of continuous agitation, it is beneficial that the formulas contain minor amounts of thickening or dispersing agents. These materials can be selected from a wide variety of water-dispersible organic polymers or, in certain instances, Bentontic clays may be used.

The water-soluble polymers may be further characterized as being polyelectrolites for purposes of this invention which means they contain a plurality of pendent polar groups or, as a portion of their molecule, contain a large number of polar or charged groupings.

Illustrative of such materials are high molecular weight water-soluble synthetic polymers such as acrylamide homo- and copolymers and water-soluble alkali metal salts of high molecular weight and acrylic acid polymers.

Another group of beneficial thickening or dispersing agents are the so-called natural gum type products which include such products as guar gum, Xanthomonas colloids and alginic acid products which are extracted from algae. The alginates form a preferred group of dispersants since they can be used in very small quantities to produce a substantial thickening and stabilization effect upon the compositions of the invention.

Other products that are contemplated for use in the invention are certain chemically-modified polysaccharides such as the well-known chemically modified cellulose ethers.

THE BIOCIDES

As previously indicated, the formulas may be treated with minor amounts of known biocides to prevent biological degredation of these materials under conditions of long-term storage. Any number of well-known biocides may be used such as, for instance, formaldehyde, sodium pentachlorophenol, certain fatty substituted quaternary ammonium salts, chlorine, bromine, or iodine and the like. The dosage of the biocide will, of course, vary depending upon the particular biocide selected.

A final optional additive that may be used in preparing the formulas of the invention is sodium hexametaphosphate. This material acts as a codispersant when used with the thickening agents previously described. It also has certain advantages in maintaining rather thick formulations fluid in a state of usable thixotropy.

The compositions thus far described may be summarized in the following table which is set forth below as a general formula:

TABLE I

| | General Formula | |
|---|---|---|
| Ingredient | % by Weight General Range | % by Weight Preferred Range |
| A. Iron Oxide, finely divided | 5 – 30 | 10 – 25 |
| B. Lignosulfonate | .1 – 25 | 2 – 10 |
| C. Graphite, finely divided | 0 – 20 | 5 – 15 |
| D. Formic acid or salt thereof | 0.1 ∝ 10 | 3 – 8 |
| E. Biocide | .5 – 2,000 ppm | — |
| F. Hexametaphosphate | .01 – .5 | — |

A specific formula of the invention that has been used successfully to coat ingot molds used for producing steel is set forth below as Composition 1:

| Ingredients | % by Weight |
|---|---|
| Iron Oxide (100 mesh) | 20 |
| Sodium Lignosulphonate (50% solution) | 10 |
| Graphite (325 mesh) | 10 |
| Sodium Formate | 5 |
| Sodium Alginate polymer | .2 |
| Formaldehyde | 1,000 ppm |
| Sodium Hexametaphosphate (20% solution) | 0.2 |
| Water | Balance |

TREATING THE INNER SURFACE OF THE MOLD

The compositions of the invention are most commonly in the form of thick paste which may be sprayed, brushed or rolled onto the surface of the mold. They may be supplied from a manufacturer in the form of concentrates which may be diluted with water or they may be supplied for use directly from their shipping containers.

While no specific amount with respect to the thickness of the coating may be stated with certainty, a typical product of the invention would be applied so that about ½ gallon of product would be sufficient to coat a 13-ton capacity ingot mold. While the coating should be spread uniformly over the entire mold surface where it will contact the molten metal, it should not be so thick so that portions thereof would fall directly into the molten steel as the ingot is teemed.

THE ADVANTAGES OF THE INVENTION

Composition 1 was applied by spraying to the inner surfaces of a 13-ton ingot mold at a rate of ½ gallon per application. The mold was recoated after each teeming. This procedure was repeated over a 60-day period. At the end of that time, no metallurgical problems were encountered and the sticker rate occasioned by removing the ingot mold from the finished ingot was about 3.5%. The same molds previously having been treated with a prior art ingot coating had sticker rates in excess of about 6.5%.

As a result of the above tests, it was determined that the best results are obtained when the inner surface of the mold prior to coating is about 400°–500° F. It was noted, however, that good results were oftentimes achieved when the mold surface was as cool as 200° F. and as hot as 1200° F. It should be noted that no metallurgical problems, e.g., unwanted inclusions were found in the finished steel products prepared from the ingots cast in the coated molds of this invention.

We claim:

1. An ingot mold for producing steel ingots having its inner surfaces coated with a composition consisting essentially of:

| Ingredients | % By Weight |
|---|---|
| A. Finely divided $Fe_2O_3$ | 5 - 30 |
| B. A lignosulfonate | .1 - 25 |
| C. Water | Balance |

2. An ingot mold for producing steel ingots having its inner surfaces coated with a composition consisting essentially of:

| Ingredients | % By Weight |
|---|---|
| A. Finely divided $Fe_2O_3$ | 10 - 25 |
| B. A lignosulfonate | 2 - 10 |
| C. Water | Balance |

3. An ingot mold for producing steel ingots having its inner surfaces coated with a composition consisting essentially of:

| Ingredients | % By Weight |
|---|---|
| A. Finely divided $Fe_2O_3$ | 5.0 - 30.0 |
| B. A lignosulfonate | 0.1 - 25.0 |
| C. Formic acid or a salt thereof | 0.1 - 10.0 |
| D. Water | Balance |

4. An ingot mold for producing steel ingots having its inner surfaces coated with a composition consisting essentially of:

| Ingredients | % By Weight |
|---|---|
| A. Finely divided $Fe_2O_3$ | 5.0 - 30.0 |
| B. A lignosulfonate | 0.1 - 25.0 |
| C. Formic acid or a salt thereof | 0.1 - 10.0 |
| D. Finely divided graphite | 5.0 - 20.0 |
| E. Water | Balance |

5. An ingot mold for producing steel ingots having its inner surfaces coated with a composition consisting essentially of:

| Ingredients | % By Weight |
|---|---|
| A. Finely divided $Fe_2O_3$ | 5.0 - 30.0 |
| B. A lignosulfonate | 0.1 - 25.0 |
| C. Organic suspending agent | Minor amount |
| D. Water | Balance |

6. An ingot mold for producing steel ingots having its inner surfaces coated with a composition consisting essentially of:

| Ingredients | % By Weight |
|---|---|
| A. Finely divided $Fe_2O_3$ | 10.0 - 25.0 |
| B. A lignosulfonate | 2.0 - 10.0 |
| C. Formic acid or a salt thereof | 3.0 - 8.0 |
| D. Water | Balance |

7. An ingot mold for producing steel ingots having its inner surfaces coated with a composition consisting essentially of:

| Ingredients | % By Weight |
|---|---|
| A. Finely divided $Fe_2O_3$ | 10.0 - 25.0 |
| B. A lignosulfonate | 2.0 - 10.0 |
| C. Formic acid or a salt thereof | 3.0 - 8.0 |
| D. Finely divided graphite | 5.0 - 15.0 |
| E. Water | Balance |

8. An ingot mold for producing steel ingots having its inner surfaces coated with a composition consisting essentially of:

| Ingredients | % By Weight |
|---|---|
| A. Finely divided $Fe_2O_3$ | 10.0 - 25.0 |
| B. A lignosulfonate | 2.0 - 10.0 |
| C. Organic suspending agent | Minor amount |
| D. Water | Balance |

9. An ingot mold for producing steel ingots having its inner surfaces coated with a composition consisting essentially of:

| Ingredients | % By Weight |
|---|---|
| A. Finely divided $Fe_2O_3$ | 5.0 - 30.0 |
| B. Lignosulfonate | 0.1 - 25.0 |
| C. Finely divided graphite | .0 - 20.0 |
| D. Formic acid or salt thereof | 0.1 - 10.0 |
| E. Biocide | 0.5 - 2,000 ppm |
| F. Sodium hexametaphosphate | 0.01 - 0.5 |
| G. Water | Balance |

10. An ingot mold for producing steel ingots having its inner surfaces coated with a composition consisting essentially of:

| Ingredients | % By Weight |
|---|---|
| A. Finely divided $Fe_2O_3$ | |

-continued

| Ingredients | % By Weight |
|---|---|
| (100 mesh) | 20.0 |
| B. Sodium lignosulfonate (50% aqueous solution) | 10.0 |
| C. Finely divided graphite | 10.0 |

-continued

| Ingredients | % By Weight |
|---|---|
| D. Sodium formate | 5.0 |
| E. Sodium alginate polymer | 0.2 |
| F. Formaldehyde | 1,000 ppm |
| G. Sodium hexametaphosphate (20% aqueous solution) | 0.2 |
| H. Water | Balance |

* * * * *

UNITED STATES PATENT OFFICE

CERTIFICATE OF CORRECTION

Patent No. U.S. 4,093,778 Dated June 6, 1978

Inventor(s) Frederick V. Reven & Charles W. Connors

It is certified that error appears in the above-identified patent and that said Letters Patent are hereby corrected as shown below:

Column 1, line 8 in the phrase

"steel. The function that most mold coatings are de-"

Should read: "metal.The function that most mold coatings are de-"

Column 4, Table I, in the phrase

"Formic acid or salt thereof 0.1 ∝ 10"

Should read: "Formic acid or salt thereof 0.1 - 10"

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*